US010478715B2

(12) United States Patent
Hunter

(10) Patent No.: US 10,478,715 B2
(45) Date of Patent: Nov. 19, 2019

(54) PROJECTILE LAUNCHING GAME

(71) Applicant: Sean T. Hunter, Richlands, NC (US)

(72) Inventor: Sean T. Hunter, Richlands, NC (US)

( * ) Notice: Subject to any disclaimer, the term of this patent is extended or adjusted under 35 U.S.C. 154(b) by 0 days.

(21) Appl. No.: 15/935,887

(22) Filed: Mar. 26, 2018

(65) Prior Publication Data

US 2019/0290998 A1 Sep. 26, 2019

(51) Int. Cl.
*A63F 9/02* (2006.01)

(52) U.S. Cl.
CPC ..... *A63F 9/0252* (2013.01); *A63F 9/0204* (2013.01); *A63F 2009/0265* (2013.01)

(58) Field of Classification Search
CPC ..... A63F 9/0252; A63F 9/0204; A63F 2009/0265
See application file for complete search history.

(56) References Cited

U.S. PATENT DOCUMENTS 5,996,565 A * 12/1999 Whitmer ..... A63B 65/12 124/17
2011/0074111 A1* 3/2011 Jackson ..... A63B 63/003 273/400

* cited by examiner

*Primary Examiner* — Jeffrey S Vanderveen
(74) *Attorney, Agent, or Firm* — Roy L. Chan, A Professional Law Corporation; Roy L. Chan

(57) ABSTRACT

A projectile launching apparatus comprising a frame, a target, and a launcher. The frame comprises a base portion and an upper portion. The target comprises a rim and a projectile receiver. The launcher comprises a projectile saddle and a plurality of resilient cords. The projectile saddle comprises a front surface and a rear surface. The projectile launching apparatus further comprises a means for attaching the plurality of resilient cords to the upper portion and a means for attaching the plurality of resilient cords to the projectile saddle. The front surface is configured to receive a projectile. The projectile receiver is attached to the rim. The rim is attached to the upper portion.

15 Claims, 4 Drawing Sheets

PROJECTILE LAUNCHING GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention is related to projectile games. The present invention may be used indoors or outdoors.

BRIEF SUMMARY OF THE INVENTION

An object of the present invention is a projectile launching apparatus comprising a frame, a target, and a launcher. The frame comprises a base portion and an upper portion. The target comprises a rim and a projectile receiver. The launcher comprises a projectile saddle and a plurality of resilient cords. The projectile saddle comprises a front surface and a rear surface. The projectile launching apparatus further comprises a means for attaching the plurality of resilient cords to the upper portion and a means for attaching the plurality of resilient cords to the projectile saddle. The front surface is configured to receive a projectile. The projectile receiver is attached to the rim. The rim is attached to the upper portion.

In another object of the present invention, the launcher further comprises a handle. The handle is attached to the rear surface of the projectile saddle.

In yet another object of the present invention, the target further comprises an inner rim and a plurality of spokes. Each spoke comprises an inner end and an outer end. The inner ends are attached to the inner rim. The outer ends are attached to the rim.

In another object of the present invention, the projectile receiver and the projectile saddle are made of a weather-resistant fabric.

In yet another object of the present invention, the weather-resistant fabric is solution-dyed acrylic.

In another object of the present invention, the projectile receiver is made of a meshed solution-dyed acrylic.

In yet another object of the present invention, the frame, the rim, and the inner rim are made of an outdoor resistant plastic, and the plurality of spokes is made of a weather-resistant cord.

In another object of the present invention, the frame, the rim, and the inner rim are made of powder-coated aluminum, and the plurality of spokes is made of a weather-resistant cord.

In yet another object of the present invention, the frame, the rim, and the inner rim are made of stainless steel, and the plurality of spokes is made of a weather-resistant cord.

In another object of the present invention, the frame further comprises a support element.

BRIEF DESCRIPTION OF THE SEVERAL VIEWS OF THE DRAWING

The advantages and features of the present invention will be better understood as the following description is read in conjunction with the accompanying drawings, wherein.

Figure 1:
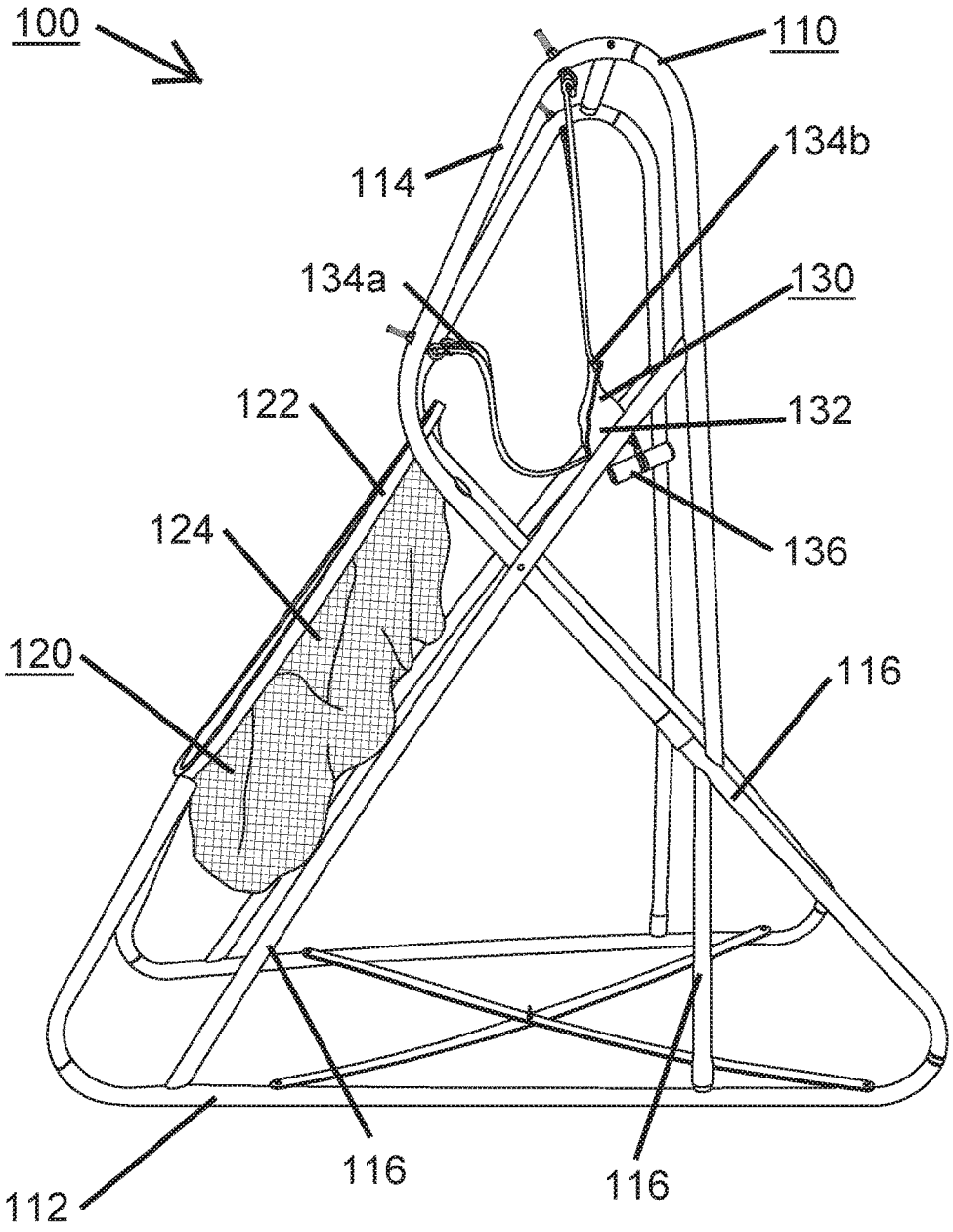
FIG. 1 is a perspective side view of an embodiment of the present invention.

For clarity purposes, all reference numerals may not be included in every figure.

DETAILED DESCRIPTION OF THE INVENTION

The figures illustrate various embodiments of a projectile launching apparatus 100 comprising a frame 110, a target 120, and a launcher 130. The frame 110 comprises a base portion 112 and an upper portion 114. The target 120 comprises a rim 122 and a projectile receiver 124. The launcher 130 comprises a projectile saddle 132 and a plurality of resilient cords 134. The projectile saddle 132 comprises a front surface 132*a* and a rear surface 132*b*. The projectile launching apparatus 100 further comprises a means for attaching the plurality of resilient cords to the upper portion 134*a* and a means for attaching the plurality of resilient cords to the projectile saddle 134*b*. The front surface 132*a* is configured to receive a projectile 200. The projectile receiver 124 is attached to the rim 122. The rim 122 is attached to the upper portion 114.

Figure 2:
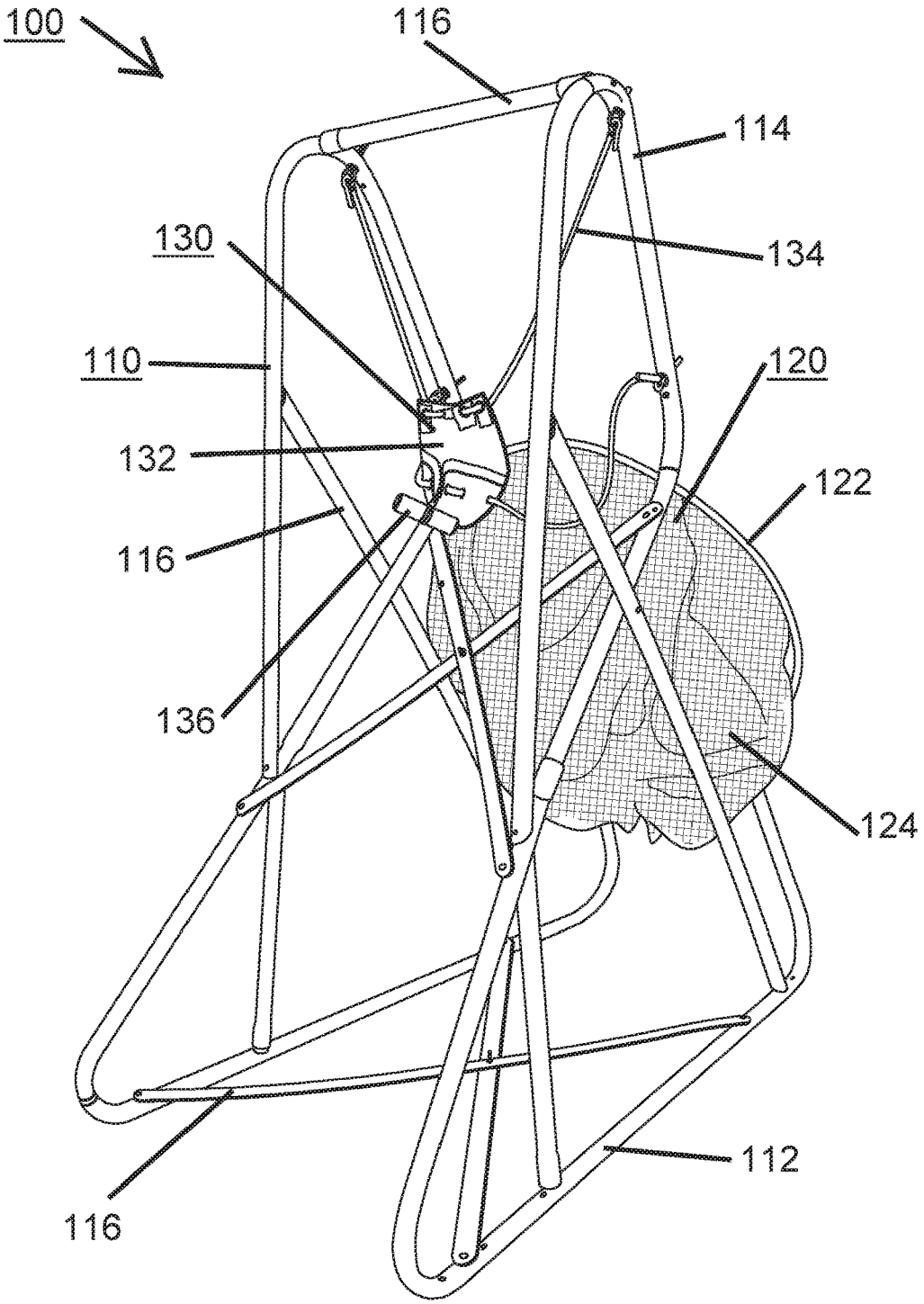
FIG. 2 is a perspective side and back view of an embodiment of the present invention.
Figure 3:
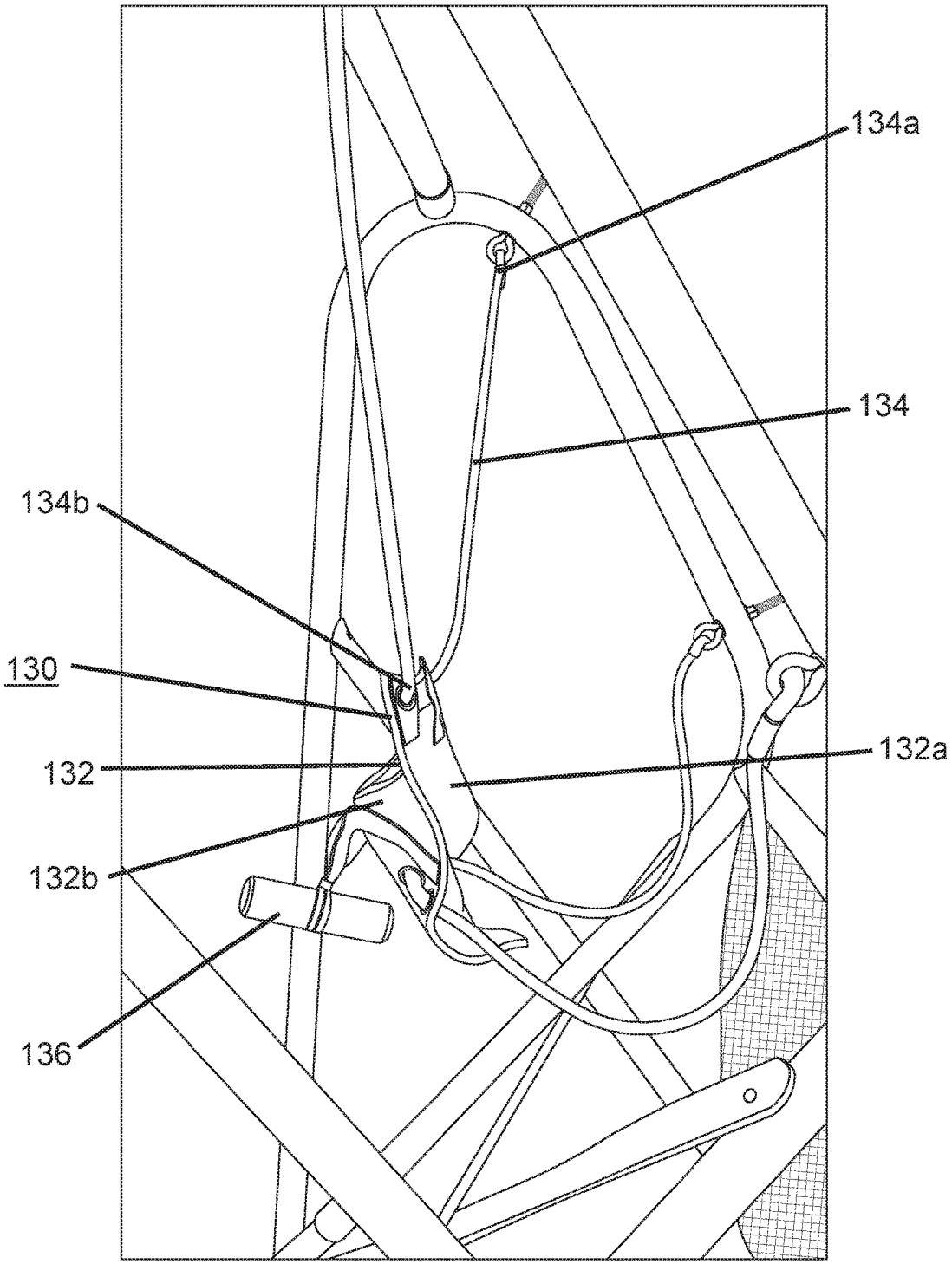
FIG. 3 is a partial view of an embodiment of the present invention.

In some embodiments, as illustrated in FIGS. 1-3, the launcher 130 may further comprise a handle 136. The handle 136 is attached to the rear surface 132*b* of the projectile saddle 132.

Figure 4:
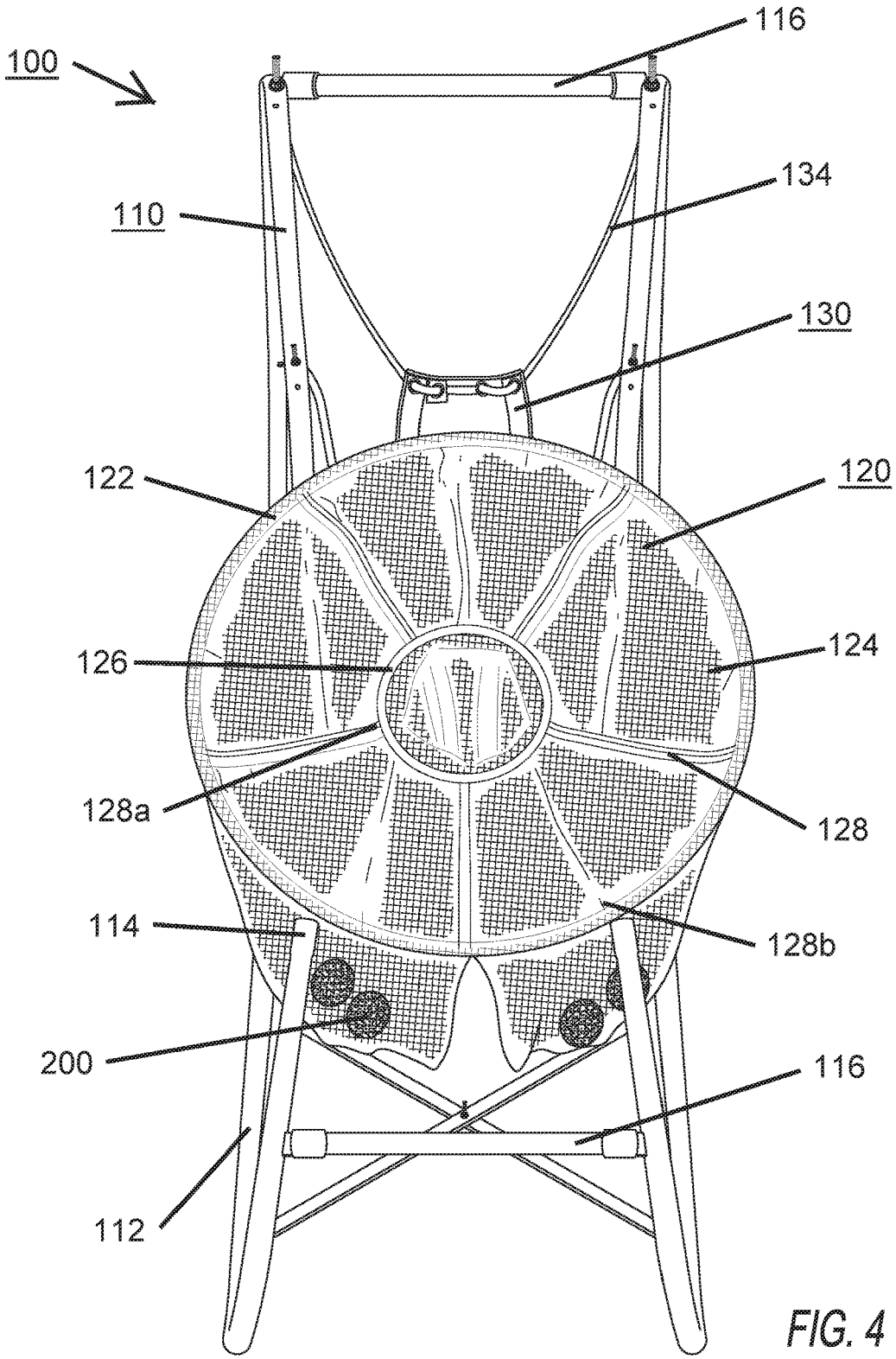
FIG. 4 is a perspective front view of an embodiment of the present invention.

As illustrated in FIG. 4, in other embodiments, the target 120 may further comprise an inner rim 126 and a plurality of spokes 128. Each spoke 128 comprises an inner end 128*a* and an outer end 128*b*. The inner ends 128*a* are attached to the inner rim 126. The outer ends 128*b* are attached to the rim 122.

Preferably, in some embodiments, the projectile receiver 124 and the projectile saddle 132 are made of a weather-resistant fabric. Weather-resistant fabrics are preferably mildew-resistant, uv-resistant, and strong. Weather-resistant fabrics may include, but are not limited to, outdoor fabrics, such as solution-dyed acrylic, acrylic coated polyester, vinyl coated synthetic fiber mesh, vinyl-polyester composite, spun polyester, other outdoor fabrics known to one skilled in the art, and combinations thereof.

In other embodiments, the weather-resistant fabric is solution-dyed acrylic.

In some embodiments, the projectile receiver 124 is made of a meshed solution-dyed acrylic.

Preferably, the frame 110, the rim 122, the inner rim 126, the plurality of spokes 128, and the handle 136 are made of a strong, rigid, lightweight material that may be hollow or solid, and is weather-resistant (uv-resistant, mildew-resistant, etc.). The materials include, but are not limited to, outdoor resistant plastic (i.e., outdoor application plastics), powder-coated aluminum, stainless steel, and combinations thereof. Outdoor application plastics are weather-resistant (uv-resistant, mildew-resistant, etc.) and may include, but are not limited to, UV stabilized high density polyethylene, UV stabilized molecular weight polyethylene, polyvinylchloride (pvc), acrylic, polycarbonate, fluorinated polymers [e.g., PTFE (polytetrafluoroethylene) and PVDF (polyvinylidene fluoride)], acrylonitrile butadiene styrene (ABS), acetal, high-density polyethylene, laminates, and combinations thereof. The plurality of spokes 128 may alternatively be made of a weather-resistant (uv-resistant, mildew-resistant, etc.) rope or cord, such as nylon ropes and cords. One example of a weather-resistant rope is paracord or 550 cord.

In some embodiments, the frame 110, the rim 122, and the inner rim 126 are made of an outdoor resistant plastic, and the plurality of spokes 128 is made of a weather-resistant rope.

In other embodiments, the frame 110, the rim 122, and the inner rim 126 are made of powder-coated aluminum, and the plurality of spokes 128 is made of a weather-resistant rope.

In some embodiments, the frame 110, the rim 122, and the inner rim 126 are made of stainless steel, and the plurality of spokes 128 is made of a weather-resistant rope.

In other embodiments, the frame 110 may further comprise a support element 116, as illustrated in FIGS. 1, 2 and 4.

A user may play the projectile launching apparatus 100 by loading a projectile 200 in the launcher 130. The user then pulls the launcher 130 away from the frame 110, thereby stretching the resilient cords 134. The user then releases the launcher 130 which shoots the projectile 200. The user may pull the handle 136 or the projectile saddle 132.

The user may launch to projectile 200 towards any target, such as an open field, other users, hoops, or another projectile launching apparatus 100. The other projectile launching apparatus 100 may have a target 120 having a rim 122 and a projectile receiver 124. In other embodiments having an inner rims and a plurality of spokes, as illustrated in FIG. 4, the user may launch the projectile 200 and different points may be awarded if the projectile 200 lands in the various portions of the target 120. For exam, if the projectile 200 lands in the center or bullseye of the target 120, then the user is awarded 100 points; in the top center, 75 points; in the top right or top left, 50 points; and, in the bottom right or bottom left, 25 points.

The projectile 200 may be balls (tennis balls, baseballs, basketballs, etc.), foam darts, snowballs, or any other projectile known to one skilled in the art.

One of ordinary skill in the art understands that the scope of the invention includes various sizes of the projectile launching apparatus 100. The projectile launching apparatus 100 may be configured to a suitable size for outdoors on the lawn; whereas one for indoors, such as for a tabletop may be configured smaller. Furthermore, depending upon the distance a user wants to launch a projectile 200, the size resilient cords may vary. Similarly, the size of the resilient cords 134 may vary to suit different strengths of different users.

The frame 110 may be constructed as the capital letter "L," where the base portion 112 is the bottom horizontal line of the "L" and the upper portion 114 is the upper vertical line of the "L." Two matching "L"s make up the frame 110. Although the figures illustrate the upper portion 114 of each "L" as being having a lower part attached to the rim 122 of the target 120 and having an upper part also attached to the rim 122, one of ordinary skill in the art understands that the scope of the invention includes embodiments where the upper portion 114 may be continuous and the rim 122 is attached to one point of each "L" of the upper portion 114. Furthermore, one of ordinary skill in the art understands that the scope of the invention includes various embodiments with various angles between the base portion 112 and the upper portion 114 of the frame 110. For example, the embodiment of the projectile launching apparatus 100 shown in FIG. 1 has an angle of about 67 degrees. Other embodiments may have a different angle, for instance, if the angle was about 85 degrees or 15 degrees, may make the target 120 more difficult for the user to land the projectile 200.

One of ordinary skill in the art understands that the scope of the invention includes various embodiments that may have no support elements 116 for the frame 110 (in other words, the frame 110 are two matching "L"s), whereas other embodiments may have one or more support elements 116. The support elements 116 may aid in stabilizing the projectile launching apparatus 100 when it is windy, when the user pulls back on the launcher 130, or when the launcher 130 recoils, among other reasons. For clarity purposes, not all of the support elements 116 have reference labels in the figures.

One of ordinary skill in the art also understands that the scope of the invention includes various diameters of targets 120. A smaller target 120 may also make the target 120 more difficult for the user to land the projectile 200.

One of ordinary skill in the art understands that the scope of the invention includes different methods of attaching the rim 122 to the upper portion 114. For example, the attachment may be near permanent, such as welding, bonding, or gluing. Alternatively, magnets may be used, therefore allowing changing the target 120 to a different configuration or different size.

Similarly, one of ordinary skill in the art understands that the scope of the invention includes different attaching means for attaching the plurality of resilient cords to the upper portion 134*a*. For example, in FIG. 3, the attachment is by use of an eye-bolt. Other alternatives may include, but are not limited to, tying the resilient cord 134 around the upper portion 114; slipping the resilient cord 134 through a hole in the upper portion 114 and knotting the end of the resilient cord 134; and other known attachment means. Likewise, one of ordinary skill in the art understands that the scope of the invention includes different attaching means for attaching the plurality of resilient cords to the projectile saddle 134*b*. For example, as illustrated in FIG. 3, the resilient cord 134 is threaded through the projectile saddle 132. Other alternatives may include, but are not limited to tying the resilient cord 134 to a hole in the projectile saddle 132; using a carabiner to attach the resilient cord 134 to the projectile saddle 132; and other known attachment means.

While the invention has been described with reference to exemplary embodiments, it will be understood by those skilled in the art that various changes, omissions, and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiments disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A projectile launching apparatus comprising:

a frame, wherein the frame comprises:

a base portion;
a front; and,
an upper portion;
a target, wherein the target comprises:
a rim;
a projectile receiver;
an inner rim; and,
a plurality of spokes, wherein each spoke comprises:
an inner end; and,
an outer end;
wherein the inner ends are attached to the inner rim; and,
wherein the outer ends are attached to the rim; and,
a launcher, wherein the launcher comprises:
a projectile saddle, wherein the projectile saddle comprises:
a front surface; and,
a rear surface; and,
a plurality of resilient cords;
a means for attaching the plurality of resilient cords to the upper portion; and,
a means for attaching the plurality of resilient cords to the projectile saddle;
wherein the plurality of resilient cords are attached to the upper portion;
wherein the plurality of resilient cords are attached to the projectile saddle;
wherein the front surface is configured to receive a projectile;
wherein the projectile receiver is attached to the rim;
wherein the rim is attached to the upper portion;
wherein the target is attached to the front of the frame;
wherein the launcher launches a projectile through an area; and,
wherein the area is above the target and the area is within the upper portion of the frame.

2. The projectile launching apparatus of claim 1, wherein the launcher further comprises a handle, and wherein the handle is attached to the rear surface of the projectile saddle.

3. The projectile launching apparatus of claim 2, wherein the projectile receiver and the projectile saddle are made of a weather-resistant fabric.

4. The projectile launching apparatus of claim 3, wherein the weather-resistant fabric is solution-dyed acrylic.

5. The projectile launching apparatus of claim 4, wherein the projectile receiver is made of a meshed solution-dyed acrylic.

6. The projectile launching apparatus of claim 5, wherein the frame, the rim, and the inner rim are made of an outdoor resistant plastic; and, wherein the plurality of spokes is made of a weather-resistant cord.

7. The projectile launching apparatus of claim 5, wherein the frame, the rim, and the inner rim are made of powder-coated aluminum; and, wherein the plurality of spokes is made of a weather-resistant cord.

8. The projectile launching apparatus of claim 5, wherein the frame, the rim, and the inner rim are made of stainless steel; and, wherein the plurality of spokes is made of a weather-resistant cord.

9. The projectile launching apparatus of claim 2, wherein the frame further comprises a support element.

10. The projectile launching apparatus of claim 9, wherein the projectile receiver and the projectile saddle are made of a weather-resistant fabric.

11. The projectile launching apparatus of claim 10, wherein the weather-resistant fabric is solution-dyed acrylic.

12. The projectile launching apparatus of claim 11, wherein the projectile receiver is made of a meshed solution-dyed acrylic.

13. The projectile launching apparatus of claim 12, wherein the frame, the rim, and the inner rim are made of an outdoor resistant plastic; and, wherein the plurality of spokes is made of a weather-resistant cord.

14. The projectile launching apparatus of claim 12, wherein the frame, the rim, and the inner rim are made of powder-coated aluminum; and, wherein the plurality of spokes is made of a weather-resistant cord.

15. The projectile launching apparatus of claim 12, wherein the frame, the rim, and the inner rim are made of stainless steel; and, wherein the plurality of spokes is made of a weather-resistant cord.

* * * * *